US006508928B2

(12) United States Patent
Dartnell et al.

(10) Patent No.: US 6,508,928 B2
(45) Date of Patent: Jan. 21, 2003

(54) RECOVERY OF METAL FROM SOLUTION

(75) Inventors: Nicholas J. Dartnell, Harrow (GB); Christopher B. Rider, New Malden (GB)

(73) Assignee: Eastman Kodak Company, Rochester, NY (US)

( * ) Notice: Subject to any disclaimer, the term of this patent is extended or adjusted under 35 U.S.C. 154(b) by 60 days.

(21) Appl. No.: 09/854,158

(22) Filed: May 11, 2001

(65) Prior Publication Data

US 2001/0040101 A1 Nov. 15, 2001

(30) Foreign Application Priority Data

May 12, 2000 (GB) ..... 0011388

(51) Int. Cl.[7] ..... C25B 15/02

(52) U.S. Cl. ..... 205/337; 205/335; 204/228.1; 204/228.3; 204/229.8; 204/230.2

(58) Field of Search ..... 205/335, 337; 204/228.1, 228.3, 229.8, 230.2

(56) References Cited

U.S. PATENT DOCUMENTS 5,451,298 A * 9/1995 Ueffinger ..... 205/337
5,783,060 A 7/1998 Bathurst et al. ..... 205/337
5,873,986 A * 2/1999 Thompson, III et al. .... 204/237
6,086,733 A * 7/2000 Carey et al. ..... 204/242
6,187,167 B1 2/2001 Dartnell et al. ..... 205/337
6,207,037 B1 * 3/2001 Dartnell et al. ..... 205/337

FOREIGN PATENT DOCUMENTS

EP 0 856 597 A 8/1998
EP 0 856 597 A1 8/1998
EP 0 972 858 A 1/2000
EP 0 972 860 A 1/2000

OTHER PUBLICATIONS

Patent Abstracts of Japan, vol. 012, No. 165 (C–496), May 18, 1988 & JP 62 274089A (Seiko Instr & Electronics Ltd.) Nov. 28, 1987, *abstract*.

* cited by examiner

*Primary Examiner*—Bruce F. Bell
(74) *Attorney, Agent, or Firm*—Chris P. Konkole

(57) ABSTRACT

The invention relates to a method for controlling the recovery of a metal, such as silver, from a solution flowing through an electrolytic cell. A constant current is applied between the anode and cathode of the cell and the rate of change of the voltage monitored, the information obtained from the monitored change of voltage being used to control the rate of recovery of the metal.

28 Claims, 5 Drawing Sheets

RECOVERY OF METAL FROM SOLUTION

FIELD OF THE INVENTION

The present invention relates to a method of controlling the recovery of metal from a solution in an electrolytic cell by plating (or deposition), onto an electrode thereof. The invention finds particular, though not exclusive application in the recovery of silver from photographic processing solutions.

BACKGROUND OF THE INVENTION

For convenience the invention will be discussed, by way of example only, with reference to photographic solutions used in black and white processing.

Photographic material, in sheet or roll film form, is processed in several stages. These stages include chemical development, fixing of the image, washing and drying.

The role of the photographic solution with fixing ability is to form soluble salts of any unexposed silver halide grains in the emulsion of the sensitised material. As more material is processed, the fixing solution becomes seasoned with soluble silver ion complexes. These complexes can reduce the fixing ability of the solution and can affect the quality of the final image. Ultimately the solution can become too loaded with silver and it would then be necessary to replace it with fresh solution. However environmental legislation is increasingly putting stricter limitations on the disposal of waste material bearing silver. Consequently, attention is increasingly being paid to safe and efficient recovery of the silver either by recovery of silver from the effluent, which is then disposed of, or by in-line treatment in which the silver bearing solutions are withdrawn from a processing tank, passed through an electrolytic cell and returned to the processing tank. The advantages of in-line electrolytic recovery of silver include i) the lifetime of the fixing solution can be extended, ii) the rate of fixing of the image can be increased, iii) the rate of replenishment of the solution with fresh chemicals can be reduced, iv) treatment of the process effluent from the processing is facilitated, and v) the value of the silver recovered is economically worthwhile.

As with any electrochemical process, however, poor control can do more harm than good. Silver recovery is no exception. When a silver recovery cell is operated efficiently the only cathodic reaction to occur is the reduction of silver ions to silver metal. This is governed by the potentials at this electrode. If too high a potential is applied, side reactions can occur which in turn lead to the production of unwanted by-products, for example silver sulphide can be formed as a fine precipitate in the solution (sulphiding). The recovery of silver is often therefore a compromise between the need for high plating currents, and consequently at higher potentials, to maintain low silver concentrations in the processing tank and the requirement of safe operation. Some large scale commercial units employ a third electrode (most commonly a reference electrode) or a silver electrode, so as to improve the efficiency of operation. However these add to the cost and problems can arise with calibration of the equipment and electrical drift. It is possible, however, with a reference electrode, for example, to limit the cathode potential so as not to exceed the potential for the formation of silver sulphide under any recovery conditions. EP 0598144 employs a third, pH electrode and the potentials of the three electrodes are controlled so as to avoid sulphiding. In addition to the disadvantage of cost of such a three electrode system, the maximum rate of removal of silver is itself limited by the fact that the potential of the cathode is kept constant.

The generally cheaper two electrode control system (using just the anode and cathode) relies on a knowledge of the cell currents and voltages for the means of control. The most common method is to use a threshold level beyond which, (above which for voltage or below which for current) it is deemed no longer suitable to recover further silver. For example when silver is recovered at a constant current, the plating voltage rises as the concentration of silver falls. In this instance the voltage is reflecting both a change of conductivity in the solution and the change of the potentials at the cathode and anode. A disadvantage of this control method is its lack of robustness as the threshold level chosen for switch off is not necessarily a suitable or even safe place to switch off for all operating conditions. This problem is exacerbated by the fact that each processor to which silver recovery is attached has a specific combination of operating parameters causing variability in the concentration of the constituents of the solution. Such operating parameters are, for example:

i) film exposure, and thus the proportion of silver that is removed by the fixer, ii) film type, and thus the quantity of silver available for development and fixing, iii) film throughput, i.e. how much film is processed per hour, iv) processor type, and thus the amount of solution that is carried into the fixing stage from the development stage and the amount of oxidation that takes place, v) the chemical composition of replenisher solution used in the various stages of the processing, and vi) the rate at which the processing solutions are replenished.

The voltage necessary to supply a certain current through a fixer solution at a given silver concentration will show a strong dependence on the pH of the solution, the concentration of sulphite and/or thiosulphate in the solution, the solution temperature and the rate at which it flows through the cell. Therefore, the specific operating parameters of the processor have a significant effect on plating conditions in the electrolytic cell through their effect on the fixer solution.

The film throughput is an important factor of the operating parameters as it governs the recovery current that must be supplied to maintain a low silver concentration in the fixer tank. Thus, although many small, commercial low-cost silver recovery units achieve crude control of plating at low currents with reasonable efficiency, these units would be unsuited to the higher recovery currents needed to maintain adequately low silver concentrations in higher throughput operations. A key geometrical design parameter, which governs maximum recovery current, is the cathode area. A large cathode facilitates high currents. However, to minimise the footprint of the silver recovery unit, a small cathode area is desirable. A requirement of an improved control system, therefore, is the ability to control the operation of the cell at relatively high current densities safely.

EP 0856597 discloses a process for monitoring the electrolyte circulation in an electrolysis cell where the electrolysis is performed by a constant current or electrode potential. The method disclosed takes multiple measurements of an electrolysis parameter over a period of time and uses these measurements to evaluate whether an error is occurring.

U.S. Pat. No. 6,187,167 discloses methods for the efficient control of a silver recovery unit containing an anode and cathode as the only electrodes. The methods are preferably operated at a constant current whilst analysing the changing plating voltages which arise from the varying silver concentrations as silver is either removed from the solution through plating or added to the solution through the processing of film. These two control methods enable the recovery process to adapt to changes in the solution by adjusting the plating current to the maximum level at which desilvering is efficient. However a disadvantage of both these methods lies in the relative nature of their operation. The control methods require two measurements to be made at different silver concentrations so that a comparison can be made. If presented with a solution of unknown concentration it is not possible for these control systems to find the most suitable de-silvering current with which to begin the de-silvering process if the silver concentration is remaining constant. A test current must be applied to cause a silver concentration change. This difficulty can be overcome if recent historical data has been stored for the same system under very similar operating conditions. There are however occasions where this approach will not be possible, for example, when recovery is performed in batch mode or when the system is used for the very first time in an in-line configuration.

Batch mode de-silvering, refers to the de-silvering of a solution under isolated conditions, i.e. the fixer solution is de-silvered once and not reused. De-silvering as referred to above, has referred to the in-situ or in-line desilvering of the solution in a processor fixer tank. In such cases the fixer solution is continuously re-circulated between the processor tank and the recovery cell during de-silvering.

In cases where the silver concentration is unknown and there is no previous historical data, it is prudent to use small test currents in case the silver concentration is low. If the silver concentration is high, on the other hand, such small currents are found to make the control methods quite insensitive to changes in silver concentration. In the high silver case for an on-line system, it is possible that the silver concentration may start to increase as film is processed at a rate faster than the small test current is desilvering the solution. In this situation, the silver in the fixer can rise to very high concentrations where fixing performance may be affected and where the silver concentration of the wash effluent can exceed discharge limits.

PROBLEM TO BE SOLVED BY THE INVENTION

It is an aim of the invention to provide an electrolytic recovery process in which an electrolytic recovery unit operating at high current density can be controlled with a two electrode control system such that there is no sulphiding, under any operating parameters. The process should be able to assess the most suitable current to apply to an unknown solution when starting the recovery process.

A method is required that can quickly give an absolute indication of the most suitable current that can be applied to an unknown solution. This is especially the case when the silver recovery unit is being used in the following situations:

i) for the first time ii) after an interruption to the process iii) if the solution is being de-silvered in batch mode.

SUMMARY OF THE INVENTION

According to the present invention there is provided a method of controlling the recovery of metal from solution flowing through an electrolytic cell containing a cathode and an anode by deposition onto the cathode thereof as current flows through the cell between the cathode and the anode under the action of a voltage thereacross, comprising the steps of a) applying one of a first constant current or voltage at a first average solution flow rate, b) changing the solution flow rate to a second average flow rate for a first period of time, c) monitoring the other of the current or voltage during the period of time, and d) obtaining information from the monitored current or voltage, the information being used to control the rate of recovery of metal from the solution.

The invention further provides a method comprising the steps of applying one of a first constant current or voltage at a first average solution flow rate, changing the solution flow rate to a second average flow rate for a first period of time, monitoring and storing the other of the current or voltage during the first time period, restoring the solution flow rate to the first flow rate, changing the one of the current or voltage to a second constant current or voltage, changing the solution flow rate to the second average flow rate for a second period of time, monitoring and storing the other of the current or voltage during the second period of time, obtaining information from the stored currents or voltages, and selecting and applying a current or voltage from the first and second current or voltage levels in response to the information obtained thereby to control the rate of recovery of metal from the solution.

Preferably the second average flow rate is substantially zero.

ADVANTAGEOUS EFFECT OF THE INVENTION

The method according to the invention is both less costly and more convenient than conventional processes known in the art. Cost is reduced by not using ancillary reference or silver sensing electrodes. This also improves convenience by eliminating the problems of electrode drift and fouling which may require the recalibration or replacement of the ancillary electrodes.

The method of the invention can give rise to control systems or methods that can be used to give efficient, adaptive silver recovery for all solutions at any known or unknown concentration. These control systems would therefore be suitable for de-silvering fixer solutions either in-line or in batch mode. Furthermore these control methods are relatively cheap and simple to implement and allow high currents to be reached very quickly, when appropriate. The methods may also be used in addition to the basic $\Delta V$ operating system, as disclosed in U.S. Pat. No. 6,187,167, in cases where there is an unknown solution which could have high silver concentration, a circumstance where the $\Delta V$ method becomes less sensitive or insensitive. Alternatively, the methods could replace the $\Delta V$ method altogether and form a control system in their own right. The $\Delta V$ method is not well suited to batch mode operation where it is always the case that the starting solution contains an unknown, and probably high, level of silver.

The invention improves the robustness of the ΔV control system allowing it to deal with solutions with high silver concentration where sensitivity is lost under normal (high flow) operating conditions. A further benefit of this is that the time taken for the control system to determine that a high plating current may be safely used is greatly reduced. This results in less possibility of the silver concentration rising to unacceptably high levels in the fixer tank.

BRIEF DESCRIPTION OF THE DRAWINGS

The method of the invention will now be described, by way of example only, with reference to the accompanying drawings.

DETAILED DESCRIPTION OF THE INVENTION

Figure 1:
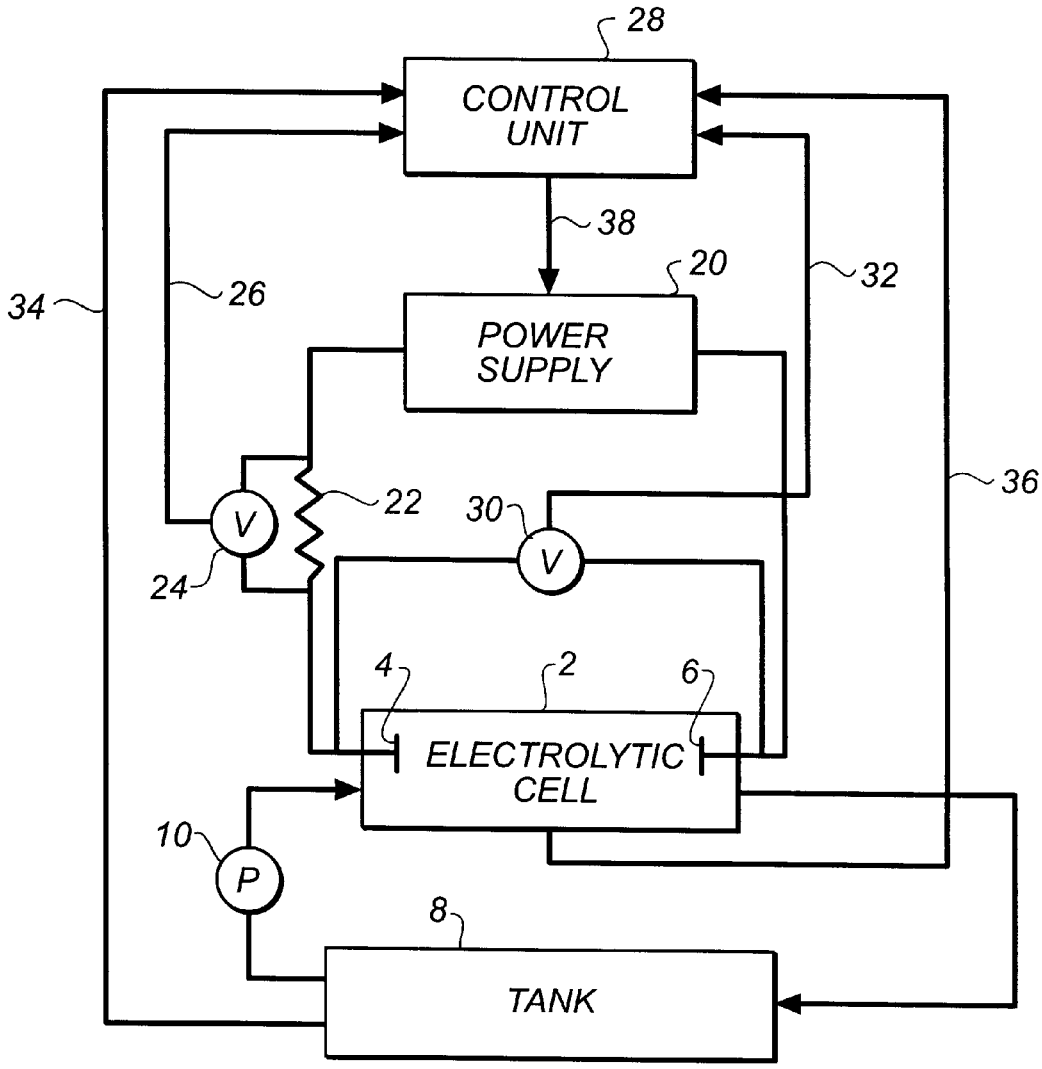
FIG. 1 is a schematic drawing of an electrolytic cell and its associated circuitry for use with the invention.

Referring to FIG. 1, an electrolytic cell 2 has an anode 4 and a cathode 6 of significantly larger surface area. Photographic fixer solution from a processing tank 8 is circulated through the cell by a pump 10.

A constant current power supply 20 supplies power to the electrodes 4, 6 of the cell 2 via a measuring resistor 22 of known value. A voltmeter 24 is connected across the ends of the resistor 22 and sends a signal along line 26, representative of the current flowing through the cell 2, to a control unit 28. A voltmeter 30 is connected externally of the cell 2 across its electrodes 4 and 6, and sends a voltage signal along line 32 to the control unit 28. The control unit 28 also receives information along a signal line 34 from the fixer tank 8, and along a signal line 36 from the cell 2, representative of conditions therein. The control unit 28 sends control signals along line 38 to the power supply 20.

Three different methods of controlling the recovery process will now be described. All relate to the effect of reducing or even stopping flow and recording the effect of this on the voltage generated at constant current.

Method 1

Figure 2:
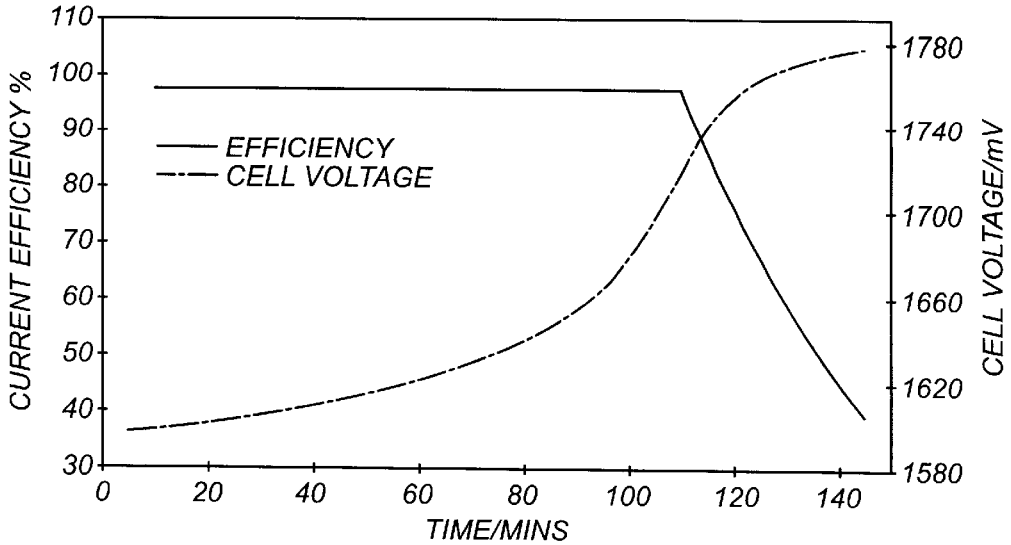
FIG. 2 is a graph plotting cell voltage and current efficiency against time.

As silver is recovered from an isolated batch of fixing solution, the silver concentration falls and a transition point is reached below which silver cannot be plated out at a rate corresponding to the applied current. Under these conditions the cell is no longer operating at 100% current efficiency. The cell voltage against time curve shown in FIG. 2 shows this as an inflection, i.e. the point of maximum rate of change of the voltage (dV/dt). In this figure the x-axis could equally be displayed as silver concentration. For these data where the solution was de-silvered at constant current the silver concentration is linearly related to the de-silvering time, with shorter times corresponding to higher silver concentrations, provided that the current efficiency is also constant.

The position, in terms of silver concentration, at which the inflection occurs is dependent on the plating current. For lower plating currents the inflection and therefore the point of loss of efficient plating is observed at lower silver concentrations, all other things, i.e. solution and operating conditions, being unchanged.

As silver is removed from the solution at the cathode surface through plating, the silver concentration is reduced and creates a boundary layer where the local concentration of solution species are different from the bulk. Good agitation at the cathode surface, provided by solution flow through the cell, aids the diffusion of silver complexes through the boundary layer to the cathode surface.

If flow is removed from a silver recovery process for whatever reason, the voltage, when operating at constant current, will rise rapidly. This is due to the silver in the boundary layer at the cathode being depleted through plating but not being replaced at the same rate through the action of the flow of fixer solution through the cell. The flow of fixer solution through the cell enhances diffusion processes and maintains an average silver concentration within the cell. The voltage curve will essentially trace the equivalent curve to that shown in FIG. 2 but over a much shorter timescale.

Figure 3:
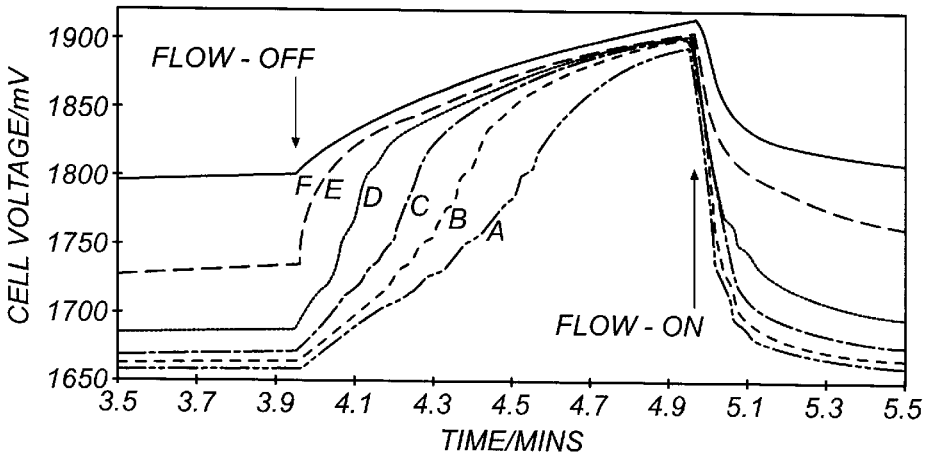
FIG. 3 is a graph plotting cell voltage against time at different levels of silver concentration as flow is stopped.

From experimental work carried out it is evident that the shape of both the voltage curve and the rate of change of voltage curve (dV/dt) just after the flow is switched off depend upon the amount of silver in the solution at the time the flow is switched off. More precisely it depends upon whether or not the recovery was efficient at the time the flow is switched off. FIG. 3 shows curves of voltage vs. time at different silver concentrations as the pump controlling the flow is switched off and then on again The operating current is a constant 2 Amps. The lowest voltage curve, curve A, is at a silver concentration of 3.02 g/l. Each successive higher voltage curve is approximately 0.3 g/l lower in silver concentration. The flow was switched off at a time of approximately 4 minutes and on again a minute later.

From the curves illustrated in FIG. 3, and other similar graphs for different currents, not shown, certain conclusions can be drawn:

If, for operation at full flow, the silver concentration is greater than the concentration at which the inefficiency point is observed, then after the flow is switched off the voltage vs. time curve will exhibit a detectable inflection. The plating at full flow was efficient and would have exhibited an inflection, (i.e. a peak in dV/dt) as the solution was desilvered. Thus when the flow is removed an inflection is recorded but on a very short timescale, as the static solution near the cathode is quickly de-silvered without being suitably refreshed with silver. This can be seen in curves A, B and C in FIG. 3 and the dV/dt vs. time curve would exhibit a peak. Effectively, by turning off the flow, we have de-silvered a very small volume of fixer (the boundary layer) in batch mode.

If, for operation at full flow, the silver concentration was close to but just above the inefficiency point at full flow, curve D for example, then the zero flow data will not show an obvious inflection but will have a very steep initial rise in voltage. This is because when flow stops the silver concentration is very quickly reduced and small inflections are not discernible above the voltage noise level. Additionally the boundary layer quickly widens in a manner which is strongly affected by the circular geometry of the cell. The evolution of the boundary layer under these conditions tends to add some initial negative curvature to the voltage vs. time curve which further hides the inflection.

Curves E and F illustrate the results from solutions which were below the efficiency point at the moment the flow was reduced. No inflection is visible in the curves and the initial gradient is enhanced by the same mechanism of the circular geometry affecting the evolution of boundary layer.

Therefore it can be concluded that by recording a voltage vs. time curve at a given current on an unknown solution with zero or substantially reduced flow, it can quickly be established whether it is safe to operate that current on the solution at full flow for extended periods of time.

Using this principle, it is possible to find the highest current which enables efficient plating for any given solution. Low test currents are used initially and the test current increased until the inflection is just not detected. The largest test current which still produces a detectable inflection is the appropriate current value to use.

It will be apparent that this method can be used to achieve the three functions which are necessary for a silver recovery control system using the adaptive control approach (use the highest current for which plating is efficient by obtaining a signal which indicates the plating efficiency):

i) determination of safe conditions to start plating from "off" state (by looking for the inflection at the lowest plating current level used by the control system):

ii) determination of safe conditions to increase the plating current from "plating" state (by looking for the inflection at the next plating current level above the present plating current): and iii) determination of when to reduce plating current as plating is on the point of becoming inefficient (by not detecting an inflection at the present plating current when the flow is stopped).

Figure 4:
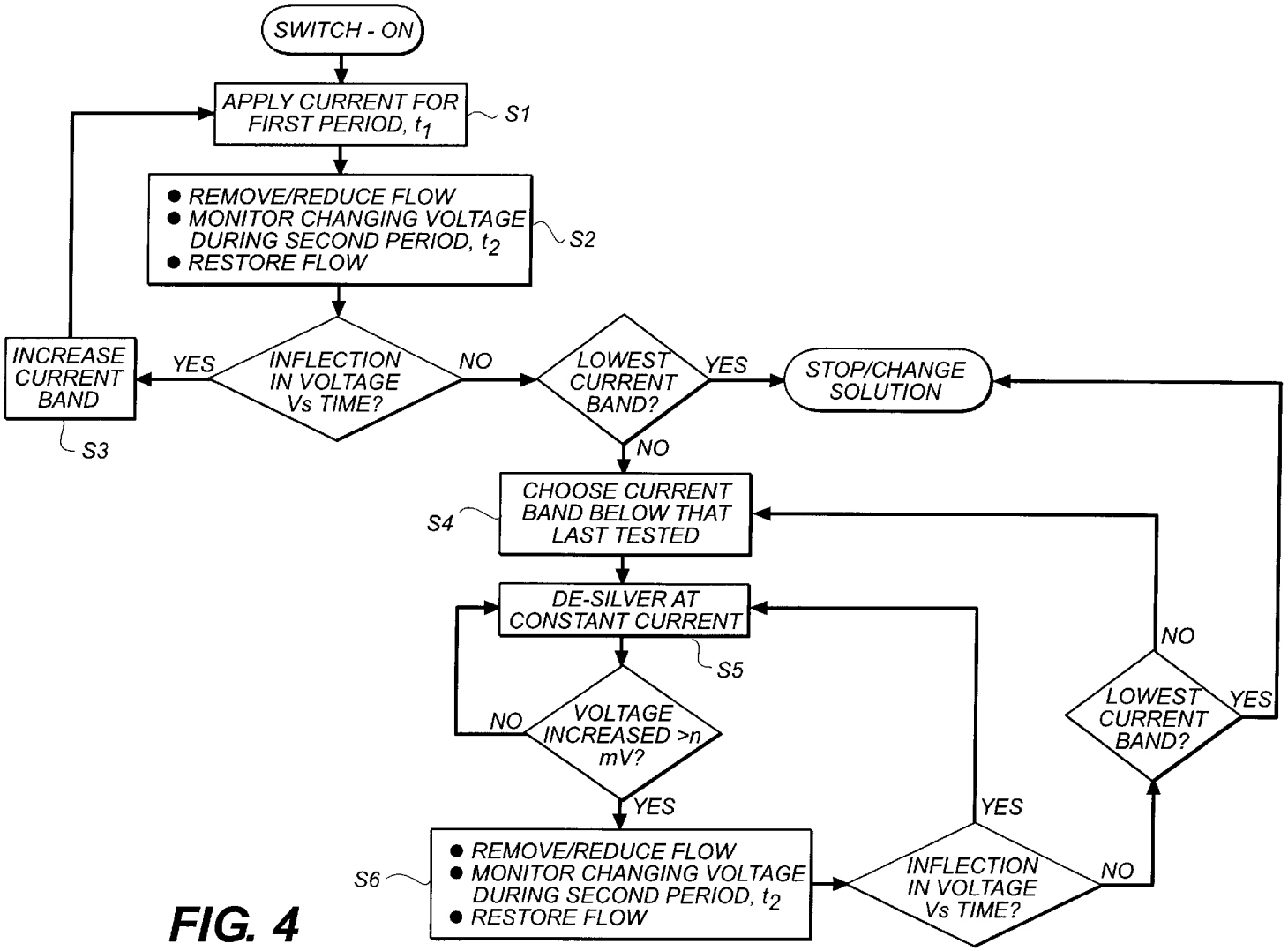
FIG. 4 is a flow chart setting out the steps used in a first embodiment of the invention.

FIG. 4 is a flow chart illustrating how the principle might be used in a control system for batch mode operation. The first loop establishes the highest safe current which can be used at the start of the de-silvering process. In step S1 the lowest current level is applied for a first period $t_1$. In step S2 the flow of solution through the cell is turned off or substantially reduced and the change in voltage monitored for a second period $t_2$. The flow of solution is then restored. If an inflection is detected in the voltage versus time curve the current is increased, step S3. This current is then applied, step S1. This loop continues until the optimum level has been selected.

A second loop handles the gradual reduction of plating current through the current levels as the silver concentration decreases. If no inflection is detected and the lowest current level is being used the solution must be changed. However if the current is not the lowest used a current below that just used is chosen, step S4 and the solution is de-silvered at that current, step S5, until the voltage increases by a predetermined level. When the voltage has increased by a predetermined value the flow of solution through the cell is turned off or substantially reduced and the change in voltage monitored for a second period $t_2$ before the flow is restored, step S6. If an inflection is observed in the voltage versus time curve the solution continues to be desilvered at that current, step S5. If no inflection is observed however, and the lowest current is not being used a lower current level is chosen, step S4, and de-silvering continues at that lower current level. If no inflection is detected and the lowest current level is being used the solution must be changed.

Method 2

The method described above provides good results but requires a control system that can record data with a good signal to noise ratio over a very short time period and which has the intelligence to interpret the shape of the recorded curve. The second method keeps to the basic principles of the first method while making simplifications to the data analysis. By monitoring the plating voltage at a constant current during the first 15 or 20 second period after the flow is removed, it has been found that two average gradient values can be derived which provide all the information needed to determine the most suitable plating current to select.

To illustrate this, an experiment was performed in which different plating currents are applied to an unknown solution for short periods of time. For each current level three voltages are recorded. The first voltage is recorded at the steady level with the pump on and solution flowing through the cell. The second recorded voltage is the voltage five seconds after the pump has been switched off. The third recorded voltage is 15 seconds after the pump has been switched off.

Figure 5:
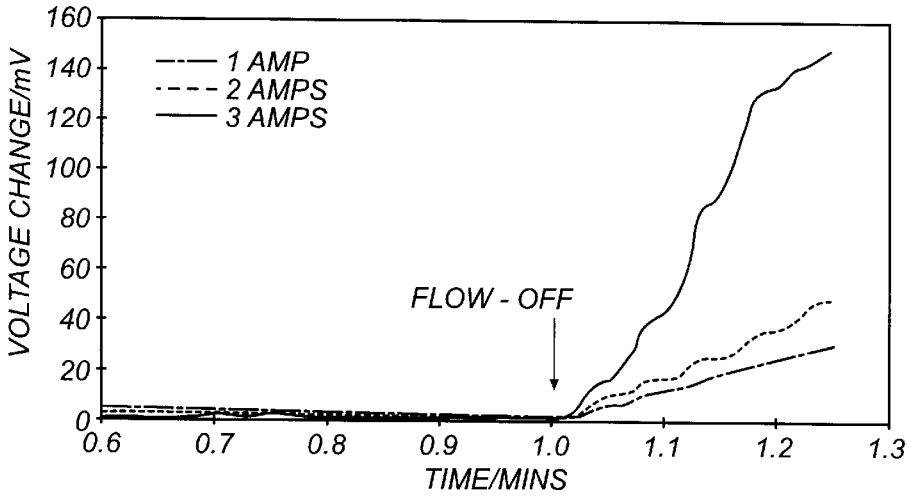
FIG. 5 is a graph plotting voltage change against time at different levels of current.
Figure 6:
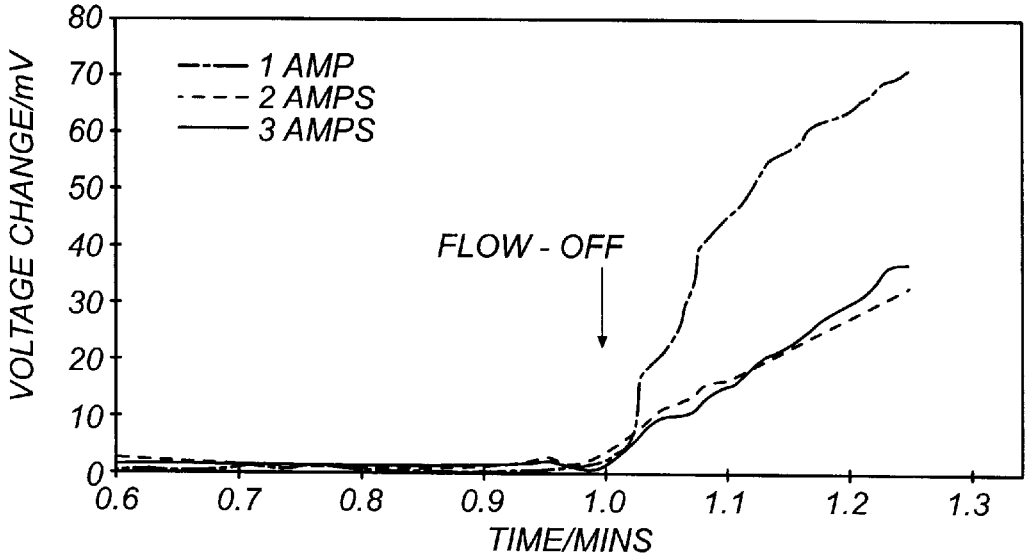
FIG. 6 is a further graph plotting voltage change against time at different levels of current.

FIGS. 5 and 6 show voltage change versus time for currents of 1, 2 and 3 amps recorded during the above-mentioned time periods on two different fixer samples. FIG. 5 shows how each voltage changed with time, starting from its value with the pump on, after the pump was stopped. It was known that this solution had a high enough silver concentration to permit efficient plating at 3 amps.

FIG. 6 shows data from a similar experiment but after the solution used for the data presented in FIG. 5 had been de-silvered to a concentration where only currents at or below 1 Amp permit efficient plating. It can be seen from the graph that the relative magnitudes of the initial gradient after the pump has been switched off recorded at different currents has changed compared to FIG. 5.

From the curves illustrated in FIGS. 3, 5 and 6, and for similar experiments performed on different fixer solutions with different silver concentrations, certain conclusions can be drawn:

In the system described, the time periods that give the best results were 5 seconds and 15 seconds. Factors that affect the selection of the optimum time periods include cell geometry and size, pump type and flow geometry.

The operating current that exhibits the greatest rate of voltage change after a 15 second period, is the current that would have been operating nearest to the inflection point at full flow. That is the current that was de-silvering nearest to the point of loss of efficient recovery at this silver concentration. Therefore applying different currents and observing the magnitude of the rate of voltage change as the flow stops can give a quick indication which current is the most suitable to apply to the solution.

If it is necessary to determine whether the chosen current is operating just above or just below the point of efficient plating the curvature of the voltage vs. time curve can be checked by assessing whether at the point where flow is stopped or reduced the silver concentration was just below or just above the point of inflection. This can be estimated with a simple test by comparing the average gradient over the first 5 seconds with that over the first 15 seconds. If the gradient over the first 5 seconds is greater that over the first 15 seconds, there is a net negative curvature implying that there is no inflection. This indicates that the current being used is higher than optimum since the silver concentration at the time the pump was switched off must have been just below the point of loss of efficient plating. On the other hand, if the gradient over the first 5 seconds is less than the gradient over the first 15 seconds, there is net positive curvature, implying that at the time the pump was switched off, the point of loss of efficiency had not been passed, and the current used would be safe to use.

Figure 7:
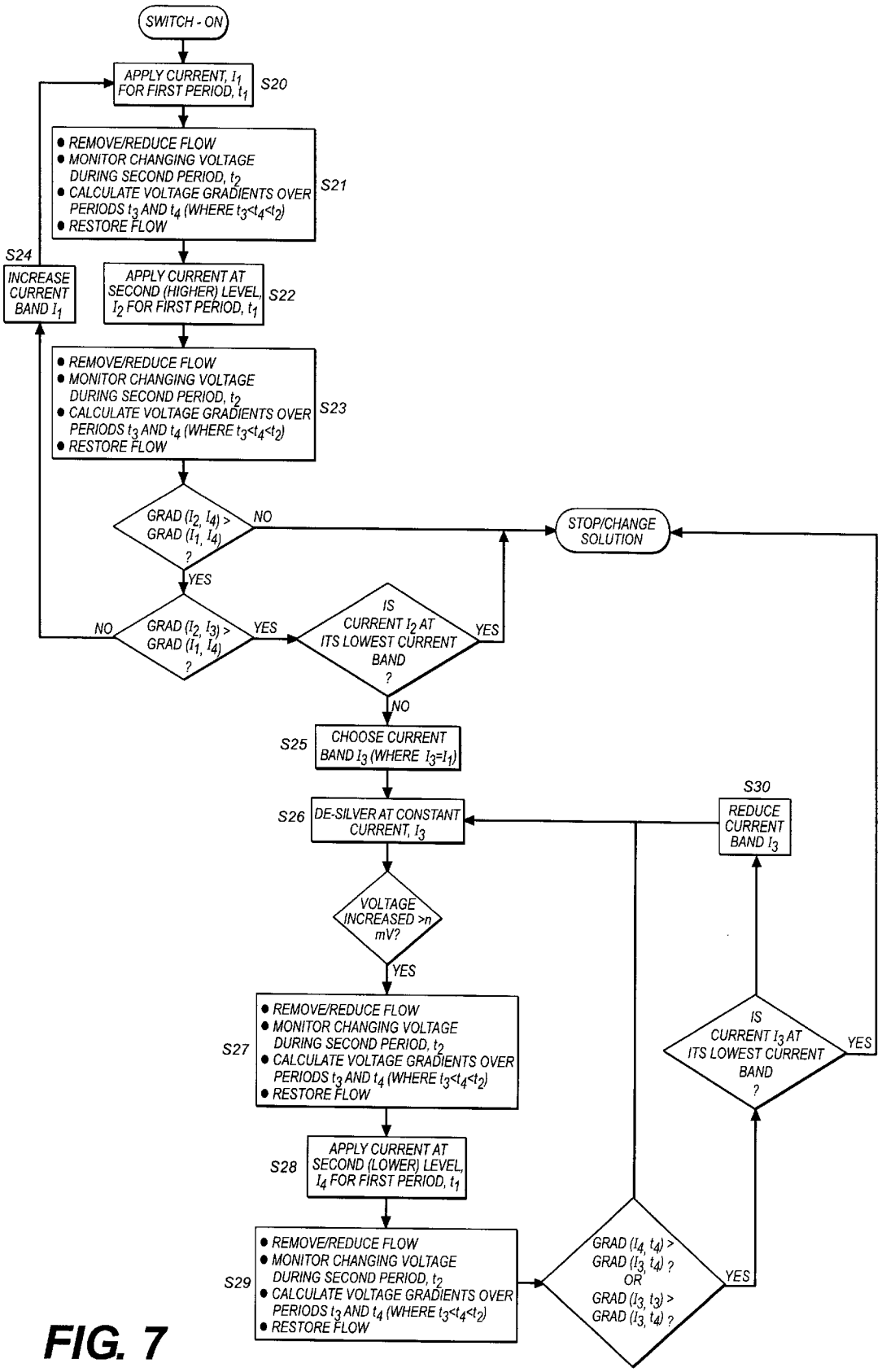
FIG. 7 is a flow chart setting out the steps used in a second embodiment of the invention.

FIG. 7 is a flow chart illustrating how this principle might be used in a control system for batch mode operation. The first loop establishes the highest safe current which can be used at the start of the de-silvering process and is similar to the flow chart shown in FIG. 4. In step S20 the lowest current level $I_1$ is applied for a first period $t_1$. In step S21 the flow of solution through the cell is turned off or substantially reduced and the change in voltage monitored for a second period $t_2$. The voltage gradient is calculated over periods $t_3$ and $t_4$ where $t_3<t_4<t_2$. The flow of solution is then restored. In step S22 the current is increased to $I_2$ and applied for the same time period $t_1$ as in step S20. In step S23 the flow of solution through the cell is again turned off or substantially reduced and the voltage gradient is calculated over the time periods $t_3$ and $t_4$ before the flow is restored. If the voltage gradient calculated for the higher current, $I_2$, over period $t_4$ is less than the voltage gradient calculated for the lower current, $I_1$, over period $t_4$ the process must be stopped and the solution changed. If the voltage gradient calculated for the higher current $I_2$ over period $t_4$ is greater than the voltage gradient calculated for the lower current $I_l$ over the same period $t_4$ it is then necessary to determine whether the voltage gradient calculated for the higher current, $I_2$, over period $t_3$ is less than the voltage gradient for the same current over period $t_4$. If yes the current $I_1$ is increased, step S24. This loop continues until the optimum level has been selected. If however the voltage gradient calculated for the higher current $I_2$ over period $t_3$ is greater than the voltage gradient for the same current over time period $t_4$ the second loop handles the gradual reduction of plating current through the current levels as the silver concentration decreases.

If the current is not the lowest used a current, $I_3$, below that just used is chosen in step S25. The solution is de-silvered at that current $I_3$, step S26, until the voltage has increased by a predetermined level. At this point the flow of solution is removed or reduced and the voltage gradient is calculated over periods $t_3$ and $t_4$ where $t_3<t_4<t_2$, as in step S21. The flow of solution is then restored. In step S28 the current is decreased to $I_4$ and applied for the same time period $t_1$ as in step S20. In step S29 the flow of solution through the cell is again turned off or substantially reduced and the voltage gradient is calculated over the time periods $t_3$ and $t_4$ before the flow is restored. The relative values of the voltage gradients determines whether or not the current needs to be lowered or the process can be continued with the present operating current.

It is possible to simplify the above process by measuring only one voltage gradient for each current value. In such an embodiment of the invention the voltage gradients calculated for each current are compared directly with each other. The relative values of the gradients determine whether the current is increased or not. If the voltage gradient for the higher current is greater than the voltage gradient at the lower current the higher current may be used. If not the desilvering is continued at the lower current.

The methods described above can not only be used as methods of finding the most suitable current to apply to an unknown solution but as the basis for the whole control system. For example once operating at the chosen de-silvering current, two voltage vs. time curves, similar to those in FIGS. 5 and 6, can be periodically recorded. One of the curves would be at the operating current level and the other either at a current level above or below the operating level dependent on whether the silver concentration is known to be increasing or decreasing. In this way comparison of data from the two curves would allow the control system to increase or decrease the operating current whilst maintaining efficient de-silvering as the silver concentration changed.

Method 3

From FIG. 1 it can be seen that the position, in terms of silver concentration, at which the voltage inflection occurs is dependent on the plating current. For lower plating currents the inflection and therefore the point of loss of efficient plating is observed at lower silver concentrations, all other things being unchanged i.e. solution and operating conditions. The $\Delta V$ method, as described in EP 99202123.8, measures the difference in voltage recorded at two different constant current levels with the same system on the same solution. A maximum in this difference is the indication used to increase or decrease the current.

This control method works well for beginning the recovery process, when the system is starting from a fresh or low silver concentration solution. No initial recovery needs to be performed until film has been processed and silver has entered the fixer solution. The problem that exists with the $\Delta V$ method is that it does not give an absolute idea of silver concentration levels. It only indicates a change in silver concentration and as a result, by comparison of values, whether operation is efficient or inefficient.

If the silver concentration in the solution is high when the recovery system is turned on, either for the first time or after an interrupted period, then the unit would be required to start recovering silver immediately. Recovery would be required at rapid rates to quickly reduce the silver and so to ensure that fixing rate is not compromised and also that silver concentration in the fixer and wash effluent does not rise too high. With the present $\Delta V$ method for switching-on under these circumstances two problems would arise. Firstly, at switch-on, the control unit would remain in standby until an indication was detected that change to the system had occurred. This may take the form of a film-input signal. Thus valuable recovery time would have been lost. Secondly, if no film input signal is available, when low currents are used on solution with high silver concentration, the sensitivity of plating voltage and $\Delta V$ to silver concentration is significantly reduced. Thus it is difficult to start the silver recovery process in a safe manner The third method is an extension to the $\Delta V$ method. It has been found that reducing the flow rate of the solution through the cell shifts the inflection observed in the voltage vs. silver concentration curve to higher silver concentrations (if recovery is efficient under both flow conditions the cell voltage may not be substantially different in the two cases). This would also shift any observed $\Delta V$ peak in the same sense. Operation at reduced flow would therefore allow $\Delta V$ probing at lower current levels to be more sensitive to changes at higher silver concentrations, and potentially provide necessary turn-on information for solutions with high silver concentrations. In practice a low cost recovery system would not have the ability to vary the flow rate of the solution but it could easily be given the ability to control the power to the pump providing the flow of solution. Experiments have shown that periods of pulsed flow i.e. short periods with flow followed by longer periods with no flow would give average voltages equivalent to a continuous flow at a reduced level. In this way $\Delta V$ curves could be recorded at effectively reduced flows.

Figure 8:
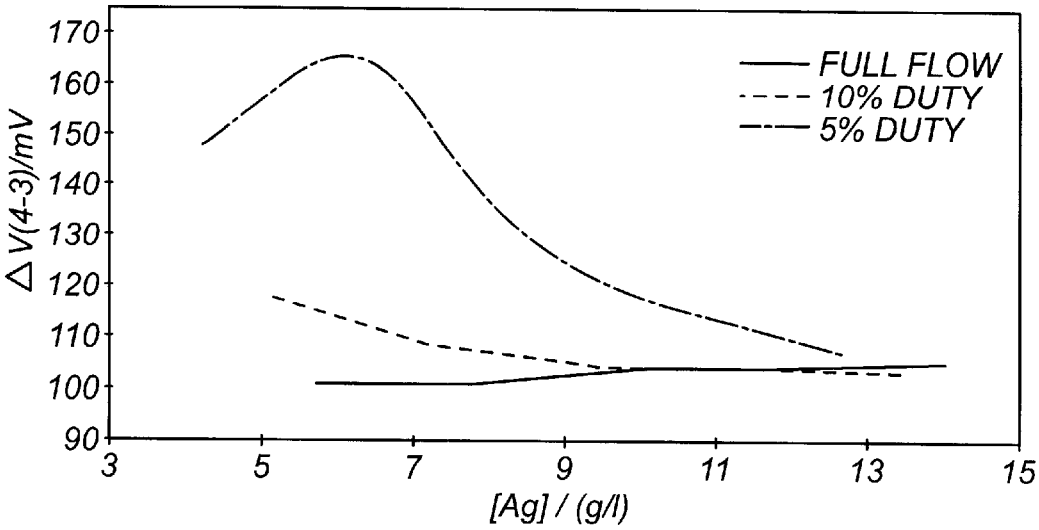
FIG. 8 is a graph plotting voltage change against silver concentration at different levels of flow.

FIG. 8 shows three $\Delta V$ curves recorded under different pulsed and continuous flow conditions, referred to as different duty cycles. The top curve was recorded at the lower average flow of the two pulsed flows. The pulsing had a period of 20 seconds and a 5% duty cycle i.e. the flow was on for one second and then off for the next 19 seconds. The middle pulsed curve was recorded for pulsing the flow with 1 second on followed by 9 seconds off, i.e. a 10% duty cycle. The lower curve was recorded for full flow. For the 5% duty cycle the ΔV curve clearly passes through a peak and at a very high concentration in the region of 6 g/l. It would also still appear to be sensitive to silver concentration changes potentially as high as 12 g/l. The curve recorded with a 10% duty cycle of pulsed flow is just starting to rise as the silver concentration drops below 6 g/l. In comparison, the curve for the full flow rate of the pump is fairly flat throughout this silver concentration region and may be expected only to peak in the region of 2 g/l.

It will be understood by those skilled in the art that the methods will work with the flow of solution either turned off or substantially reduced. The reduction in flow may be achieved by any suitable means such as reducing pump voltage or by pulsing the pump on and off. It is possible, though not desirable, for a control system to be made to work by increasing pump flow and monitoring the inflections.

The methods and experiments disclosed use the principle of monitoring voltages at constant current. It will be understood by those skilled in the art that it would also be possible to use a constant voltage system and monitor the changes in the current as inflections would also be detected in current versus time curves. It is also possible to use the method in a recovery unit employing a third, reference electrode.

It will be understood that the method of the invention is applicable to the recovery of metals other than silver, e.g. gold, copper, nickel, etc.

PARTS LIST

2. electrolytic cell
4. anode
6. cathode
8. tank
10. pump
20. power supply
22. resistor
24. voltmeter
26. signal line
28. control unit
30. voltmeter
32. signal line
34. signal line
36. signal line
38. signal line

What is claimed is:

1. A method of controlling the recovery of metal from solution flowing through an electrolytic cell containing a cathode and an anode by deposition onto the cathode thereof as current flows through the cell between the cathode and the anode under the action of a voltage thereacross, comprising the steps of a) applying one of a first constant current or voltage at a first average solution flow rate, b) changing the solution flow rate to a second average flow rate for a first period of time, c) monitoring the other of the current or voltage during the period of time, and d) obtaining information from the monitored current or voltage, the information being used to control the rate of recovery of metal from the solution.

2. A method as claimed in claim 1 wherein the second average flow rate is substantially zero.

3. A method as claimed in claim 1 wherein step d includes determining the presence or absence of an inflection in the monitored current or voltage thereby to control the rate of recovery of metal from the solution.

4. A method as claimed in claim 1 wherein the steps of a, b, c and d are repeated at least once at different current or voltage levels, the information obtained from each application of steps a to d being used to control the rate of recovery of metal from the solution.

5. A method as claimed in claim 1 wherein the monitored current or voltage is stored.

6. A method as claimed in claim 5 wherein the second average flow rate is substantially zero.

7. A method as claimed in claim 5 wherein a current or voltage gradient is determined from the stored currents or voltages at both the first and second constant levels, the gradients compared to each other and the current or voltage selected in response to which gradient has the highest value.

8. A method as claimed in claim 1 wherein the flow of solution is changed by reducing the pump voltage.

9. A method as claimed in claim 1 wherein the average flow of solution is changed by pulsing the pump off and on.

10. A method as claimed in claim 1 wherein the metal is silver and is recovered from a photographic processing solution in the cell.

11. A method of controlling the recovery of metal from solution flowing through an electrolytic cell containing a cathode and an anode by deposition onto the cathode thereof as current flows through the cell between the cathode and the anode under the action of a voltage thereacross, comprising the steps of applying one of a first constant current or voltage at a first average solution flow rate, changing the solution flow rate to a second average flow rate for a first period of time, monitoring and storing the other of the current or voltage during the first time period, restoring the solution flow rate to the first flow rate, changing the one of the current or voltage to a second constant current or voltage, changing the solution flow rate to the second average flow rate for a second period of time, monitoring and storing the other of the current or voltage during the second period of time, obtaining information from the stored currents or voltages, and selecting and applying a current or voltage from the first and second current or voltage levels in response to the information obtained thereby to control the rate of recovery of metal from the solution.

12. A method as claimed in claim 11 wherein the second average flow rate is substantially zero.

13. A method as claimed in claim 11 wherein a current or voltage gradient is determined from the stored currents or voltages at both the first and second constant levels, the gradients compared to each other and the current or voltage selected in response to which gradient has the highest value.

14. A method as claimed in claim 11 wherein two current or voltage gradients are determined from the stored currents or voltages at both the first and second constant levels, gradients at each constant level firstly being compared to each other and secondly the gradients within each constant level being compared to each other, the current or voltage being selected in response to the relative magnitude of the gradients.

15. A method as claimed in claim 11 wherein the flow of solution is changed by reducing the pump voltage.

16. A method as claimed in claim 11 wherein the average flow of solution is changed by pulsing the pump off and on.

17. A method as claimed in claim 11 wherein the metal is silver and is recovered from a photographic processing solution in the cell.

18. A method of controlling the recovery of metal from solution flowing through an electrolytic cell containing a cathode and an anode by deposition onto the cathode thereof as current flows through the cell between the cathode and the anode under the action of a voltage thereacross, comprising the steps of reducing the flow rate of the solution for a period of time, monitoring the rate of change in one of the current flowing and voltage difference between the cathode and the anode due to variation in the concentration of the metal in the solution during this period of time and modifying the other of said current and voltage in response to said monitored rate of change or voltage difference thereby to control the rate of recovery of the metal from the solution.

19. A method as claimed in claim 18 wherein the flow of solution is changed by reducing the pump voltage.

20. A method as claimed in claim 18 wherein the average flow of solution is changed by pulsing the pump off and on.

21. A method as claimed in claim 18 wherein the metal is silver and is recovered from a photographic processing solution in the cell.

22. A method of controlling the recovery of metal from solution flowing through an electrolytic cell containing a cathode and an anode by deposition onto the cathode thereof as current flows through the cell between the cathode and the anode under the action of a voltage thereacross, in which information obtained from monitoring the current or the voltage which is subsequently used for controlling the rate of recovery is obtained during periods of reduced average solution flow.

23. A method as claimed in claim 22 wherein the flow of solution is changed by reducing the pump voltage.

24. A method as claimed in claim 22 wherein the average flow of solution is changed by pulsing the pump off and on.

25. A method as claimed in claim 22 wherein the metal is silver and is recovered from a photographic processing solution in the cell.

26. Apparatus for controlling the recovery of metal from solution flowing through an electrolytic cell containing a cathode and an anode by deposition onto the cathode thereof as current flows through the cell between the cathode and the anode under the action of a voltage thereacross, comprising a) means for applying one of a first constant current or voltage at a first average solution flow rate, b) means for changing the solution flow rate to a second average flow rate for a first period of time, c) means for monitoring the other of the current or voltage during the period of time, and d) means for obtaining information from the monitored current or voltage, the information being used to control the rate of recovery of metal from the solution.

27. Apparatus for controlling the recovery of metal from solution flowing through an electrolytic cell containing a cathode and an anode by deposition onto the cathode thereof as current flows through the cell between the cathode and the anode under the action of a voltage thereacross, comprising means for applying one of a first constant current or voltage at a first average solution flow rate, means for changing the solution flow rate to a second average flow rate for a first period of time, means for monitoring and storing the other of the current or voltage during the first time period, means for restoring the solution flow rate to the first flow rate, means for changing the one of the current or voltage to a second constant current or voltage, means for changing the solution flow rate to the second average flow rate for a second period of time, means for monitoring and storing the other of the current or voltage during the second period of time, means for obtaining information from the stored currents or voltages, and means for selecting and applying a current or voltage from the first and second current or voltage levels in response to the information obtained thereby to control the rate of recovery of metal from the solution.

28. Apparatus for controlling the recovery of metal from solution flowing through an electrolytic cell containing a cathode and an anode by deposition onto the cathode thereof as current flows through the cell between the cathode and the anode under the action of a voltage thereacross, comprising means for reducing the flow rate of the solution for a period of time, means for monitoring the rate of change in one of the current flowing and voltage difference between the cathode and the anode due to variation in the concentration of the metal in the solution during this period of time and means for modifying the other of said current and voltage in response to said monitored rate of change or voltage change thereby to control the rate of recovery of the metal from the solution.

* * * * *